United States Patent [19]

Kukulski

[11] 4,139,179

[45] Feb. 13, 1979

[54] HOISTING APPARATUS

[76] Inventor: Zdzislaw Kukulski, 41074 Corriea Ct., Fremont, Calif. 94538

[21] Appl. No.: 845,955

[22] Filed: Oct. 27, 1977

[51] Int. Cl.[2] ..... B66D 1/36

[52] U.S. Cl. ..... 254/192; 294/74

[58] Field of Search ..... 254/192, 193, 195, 196, 254/190 R, 167, 188, 135 R; 294/74, 78 R, 97, 86 LS; 214/1 P; 248/60, 61, 329; 24/265 R

[56] References Cited

U.S. PATENT DOCUMENTS

| | | | |
|---|---|---|---|
| 1,672,823 | 6/1928 | McMillan | 254/193 |
| 2,202,184 | 5/1940 | Berger | 254/195 |
| 2,629,625 | 2/1953 | Phillips | 294/74 |
| 2,638,184 | 5/1953 | Sturdivant | 188/64 |

FOREIGN PATENT DOCUMENTS

| | | | |
|---|---|---|---|
| 676960 | 12/1963 | Canada | 254/192 |
| 225398 | 2/1969 | U.S.S.R. | 294/78 R |

*Primary Examiner*—Trygve M. Blix
*Assistant Examiner*—Kenneth W. Noland
*Attorney, Agent, or Firm*—Poms, Smith, Lande, Glenny & Rose

[57] ABSTRACT

A load or cargo lifting and moving apparatus for use with a hoisting hook includes a sling or cable for securing to a load, and a special pulley for balancing the loaded sling and lifting it. The pulley includes a shackle and a roller having a deeply grooved and knurled surface for engaging the sling, and a pin for locking the roller against rotation in the shackle. In operation the sling is initially secured to the load, the pulley is raised with the roller free to rotate, until the load is balanced, and the roller is then pinned against rotation as the load is moved to its final location. The sling may be provided with hooks for engaging a load, which could be a long unbalanced pipe, for example.

13 Claims, 7 Drawing Figures

INVENTOR.
ZDZISLAW KUKULSKI
BY F. D. Kerper
ATTORNEY

INVENTOR.
ZDZISLAW KUKULSKI
BY
ATTORNEY

HOISTING APPARATUS

FIELD OF THE INVENTION

This invention relates to a method and apparatus for use with a hoisting hook, for lifting beams, pipes, and unbalanced objects by a sling after locating the center of gravity of the object.

BACKGROUND OF THE INVENTION

When it is desired to hoist a long pipe having one heavy end, or other irregularly balanced or shaped loads, the load may easily shift if the sling is not held at its balance point. However, if a conventional pulley is employed at the hoisting hook to balance the sling or cable, a slight bump in transit may start the sling rolling on the pulley roller, and unbalance the load.

Accordingly, a principal object of the present invention is to provide a balanced and stable method and apparatus for hoisting irregularly shaped or balanced loads.

SUMMARY OF THE INVENTION

The method of the present invention involves the initial securing of a sling or cable to a load, lifting the cable on a special pulley, balancing the load by moving the cable on the roller of the pulley, and after the load is balanced, pinning the roller against rotation in the shackle, and proceeding to move the load.

The special pulley includes a deeply grooved roller to fit the cable, a shackle, and special pinning arrangements for locking the roller against rotation in the shackle. The surface of the roll or roller may be knurled or otherwise roughened to increase the frictional engagement between the cable and the roller.

Arrangements for pinning the roller to the shackle may include at least one transverse hole through the roller and a pin for extending through the hole to keep the roller from rotating relative to the shackle. The locking pin may be tethered to the shackle, may be provided with an additional locking mechanism to keep it from falling out, and may be U-shaped to extend around the shackle and through two holes in the pulley.

In accordance with another feature of the invention, the shackle may be hook shaped, or open on one side, so that the cable may be mounted on the pulley from the side.

The above and other novel features of the invention will appear more fully hereinafter from the following detailed description when taken in conjunction with the accompanying drawings. It is expressly understood that the drawings are employed for purposes of illustration only and are not designed as a definition of the limits of the invention, reference being had for this purpose to the appended claims.

DETAILED DESCRIPTION

Figure 1:
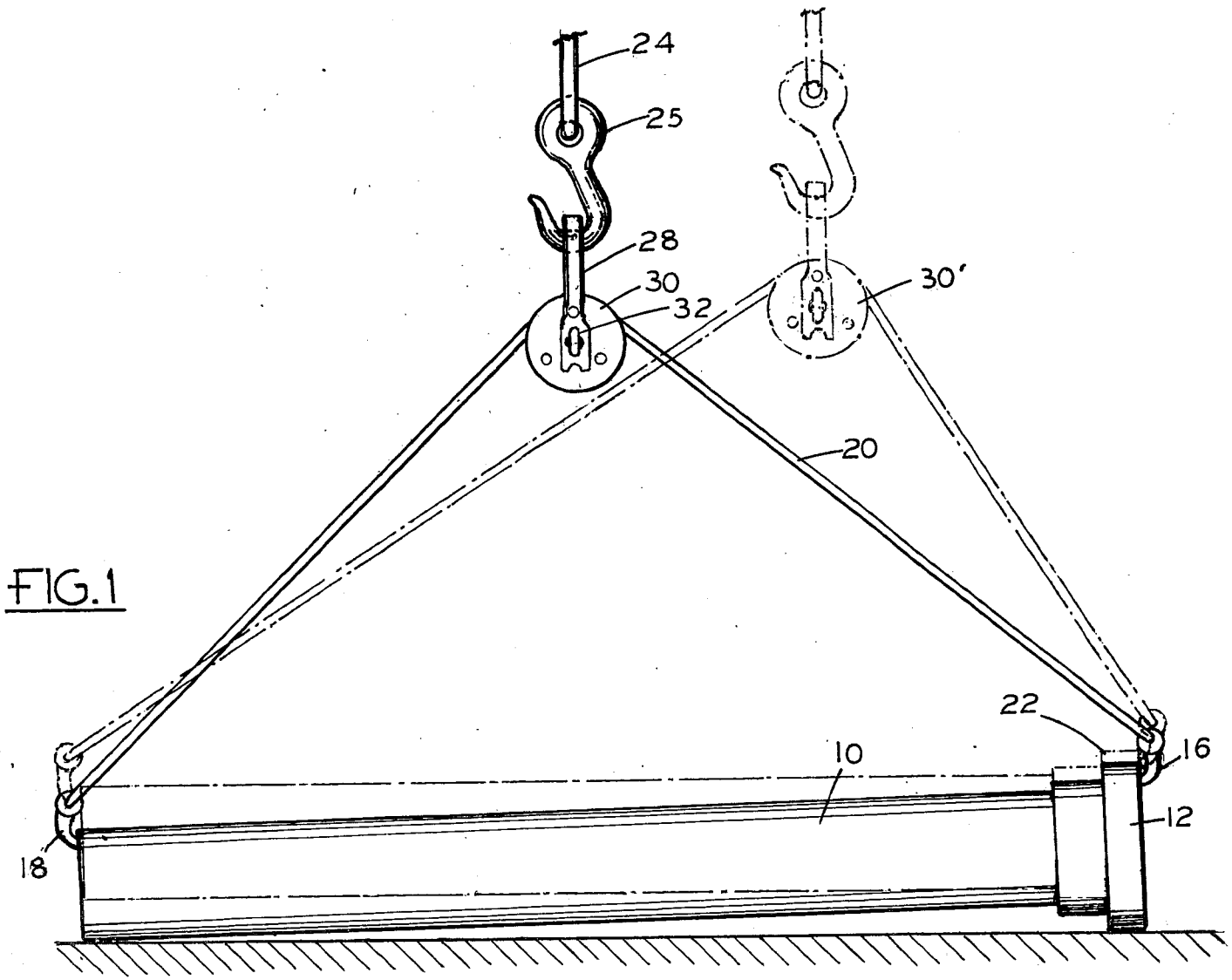
FIG. 1 is a diagrammatic illustration showing the procedure to locate a balance point, or center of gravity of a long object, about to be lifted by the sling.

In FIG. 1 there is shown an object such as a long beam or pipe 10 having a heavy fitting 12 on one end, rendering it difficult to judge the center of gravity for lifting the object by a sling on a hook. If the object be not balanced, the sling may shift on the hook, unless lashed to prevent slippage, when subjected to lifting acceleration or deceleration. As indicated in FIG. 1, the hoisting cable 24 and hook 25 of a crane or the like are fitted with a shackle or yoke 28, in which there is a deep grooved roll 30, freely rotatable upon a member such as a shackle pin or arm 32. Over the roll 30 is a cable or sling 20 having end hooks 16 and 18. The roll is moved along the sling to the right as indicated in FIG. 1 until the roll reaches a point 30' at which the object to which the sling is attached shows a tendency to balance by the lifting of the light end 18 from the ground. At this point, the roll is keyed against rotation relative to the shackle, and hoisting of the object may safely take place.

Figure 3:
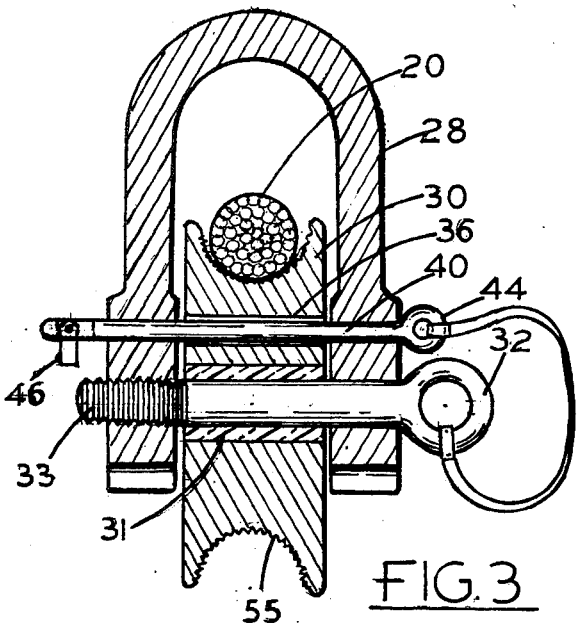
FIG. 3 is a sectional view taken on the line 3—3 of FIG. 2.
Figure 2:
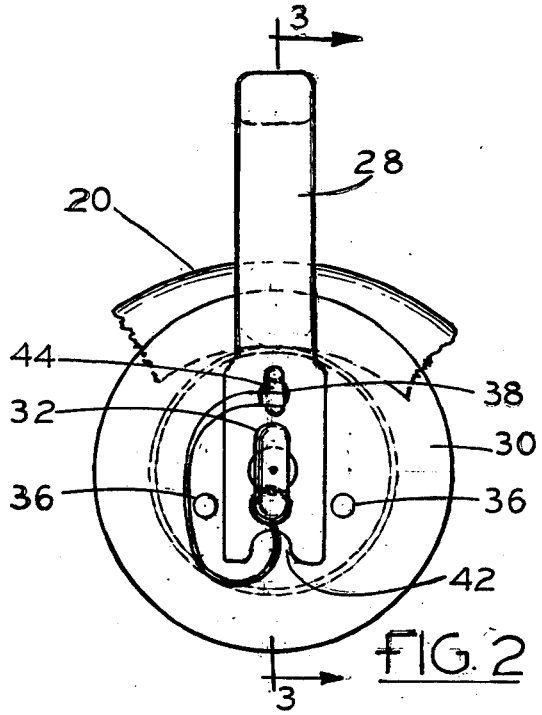
FIG. 2 is an enlarged side view of the shackle and roll.
Figure 4:
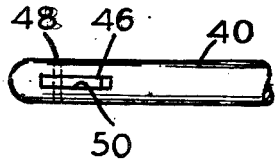
FIG. 4 is an enlarged fragmentary view of the locking pin end showing the key.

Referring to FIGS. 2, 3, and 4, the apparatus is shown in more detail, the shackle or yoke 28 being fitted with a shackle pin 32 upon which the widely grooved roll 30 is pivoted. The shackle pin 32 may be threaded into one arm of the shackle as at 33, and the roll may have a bearing sleeve 31 to ease the rotation of the roll. The roll, as shown may have three apertures 36 disposed at equal angles, or 120° around the roll and the shackle may have an aperture 38 adapted to be aligned with a roll aperture, so as to readily receive a locking pin 40. The shackle arm ends may be notched as at 42 to further receive the locking pin 40 whereby three apertures provide locking position every 60°. The locking pin may have an eye 44 in one end, and a locking key or blade 46 pivoted at 48 in a slot 50 in the key end, so that when the locking pin is in position, the key may drop as shown in FIG. 3 to prevent loss of the pin, or its removal, except when the key is swung into the slot so as to be aligned with the locking pin axis whereupon the locking pin is recessed in the slot and may be removed.

It will also appear that the aperture 38 or notches 42 may be eliminated since the locking pin may be merely extended through an aperture in the roll that is laterally disposed from the shackle arm, so that roll rotation is prevented by engagement of the locking pin against the sides of the shackle arms to limit rotation.

Figure 5:
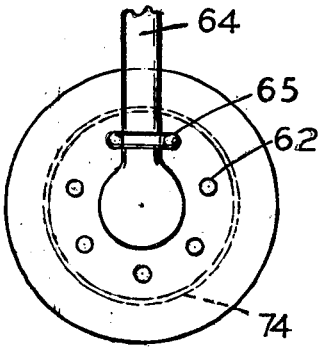
FIG. 5 is a side view of an alternate form of the invention.
Figure 6:
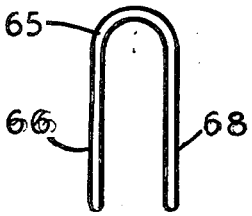
FIG. 6 is a view of the U-clamp employed in FIG. 5.

In FIGS. 5 and 6 a further form of the invention is shown, wherein the roll 60 is provided with a plurality of apertures 62, equally spaced by a distance greater than the width of the shackles arms 64. In this arrangement a U-shaped locking pin 65 is employed, the two parallel legs 66 and 68 of the pin being spaced to correspond to the spacing of the apertures 62 so that the pin may embrace an arm 64 at the side and project along the opposite sides of the shackle arm 64 when the lock pin is in position as shown in FIG. 5. The number of roll apertures should be adequate to provide locking close to the roll position where balance is achieved.

By providing the roll with a knurled surface as at 55, slippage of the sling or cable 20 from its balance position on the roll is resisted, should the object in hoisting strike some other object that might tend to shift the object from its balanced support position.

Figure 7:
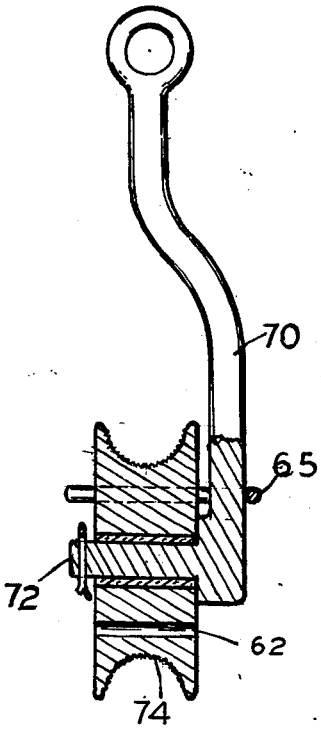
FIG. 7 is a view of a further modification.

Upon lowering the object to the ground, or on shipboard, the lock pin may be removed, and the shackle rolled to the center of the sling, after which the lock pin can be reinserted, so as to be available for use in connection with the next object to be hoisted. The lock pin can be tethered to the eye of the shackle pin as shown in FIG. 3 to guard against accidental dropping. While a shackle form of lifting device has been shown, the shackle could be in hook form with a single side arm with the roll pivoted on a horizontal arm extension of the side arm. While the strength of such an arm would have to be such as to resist the contilever load, such a roll could have the sling applied from the side without threading through the shackle. Such arrangement is illustrated in FIG. 7, where the arm 70 is provided with a lateral extension 72 on which the roll 74 is pivoted. The roll may be locked against rotation by the U lock pin 65 as indicated, or by a straight pin 40 passing through an aperture or a notch in the side arm as indicated in FIG. 2.

In each form of the pulley, the shackle is provided with arrangements to permit easy hoisting of the shackle and roller, such as the opening in arm 70, or the extended upper loop of the member 28, as shown in FIGS. 1 and 3, for example.

While several forms of the invention have been illustrated and described, it is to be understood that the invention is not limited thereto, and that various changes in the construction and arrangement may be made without departing from the spirit of the invention.

What is claimed is:

1. An apparatus for safely hoisting an unwieldy load from a support on which it is resting comprising:

a cable or sling for securing to the load to be hoisted, said cable or sling having a generally circular configuration over the greater portion of its length;

means including a pulley having a grooved roller and a shackle for supporting said cable, said roller normally being freely rotatable in said shackle;

means for moving said pulley generally parallel to the support on which the load is resting and in a direction transverse to the axis of said roller without lateral movement of said load to determine the balance point of the cable with the load attached to it, and for subsequently lifting and transporting said load; and mechanical means for locking said roller against rotation in said shackle in both directions, as said load is being transported.

2. An apparatus as defined in claim 1 further comprising means for attaching the ends of said cable to a load.

3. An apparatus as defined in claim 1 further comprising a hoisting hook engaging said shackle.

4. An apparatus as defined in claim 1 wherein the outer surface of said roller is deeply grooved to match the cross-sectional configuration of said cable.

5. An apparatus as defined in claim 1 wherein the surface of said roller is of roughened configuration to increase the frictional engagement with said cable.

6. An apparatus as defined in claim 1 wherein said roller includes at least one transverse aperture, and further comprising means for pinning said roller against rotation relative to said shackle by passing through said aperture.

7. An apparatus as defined in claim 6 wherein said roller is provided with a plurality of transverse apertures, and locking pin means is provided for extending through one of said apertures and locking said roller against rotation relative to said shackle.

8. An apparatus as defined in claim 7 wherein said locking pin includes additional means for holding it in the locking position.

9. An apparatus as defined in claim 7 wherein means are provided for tethering said locking pin to said shackle.

10. An apparatus as defined in claim 1 wherein said shackle is of hook form, thereby permitting said cable to be mounted over said roller from the open side of said shackle.

11. An apparatus as defined in claim 1 wherein said roller is transversely apertured and the only means for restraining said roller against rotation consists solely of pin means for extending through an aperture in said pulley.

12. A method for safely and stably hoisting and transporting unwieldy loads comprising:

securing the two ends of a sling or a cable to an unwieldy or unbalanced load;

applying tension to the cable through a special pulley including a shackle and a grooved roller having a surface configured to frictionally engage said cable, without lifting the load;

moving the pulley laterally along the cable transverse to the axis of the roller with the load still in position until the load is substantially balanced relative to the cable and pulley and in the desired orientation;

locking the pulley against rotation relative to the shackle; and lifting and transporting the balanced load to the desired location by hoisting on the shackle of said pulley.

13. A method as set forth in claim 12 comprising the additional step of applying sufficient force to said pulley to slightly move and load as said pulley is being moved along said cable, prior to locking the pulley in position.

* * * * *